US007517494B2

(12) United States Patent
Childers et al.

(10) Patent No.: US 7,517,494 B2
(45) Date of Patent: Apr. 14, 2009

(54) TEST TRAY AND TEST SYSTEM FOR DETERMINING RESPONSE OF A BIOLOGICAL SAMPLE

(75) Inventors: Winthrop D. Childers, San Diego, CA (US); Michael K. Gordon, Poway, CA (US); Mark A. Van Veen, Cardiff by the Sea, CA (US); Mohammad M Samii, La Jolla, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 839 days.

(21) Appl. No.: 10/428,289

(22) Filed: Apr. 30, 2003

(65) Prior Publication Data

US 2004/0219074 A1 Nov. 4, 2004

(51) Int. Cl.
*B01L 3/00* (2006.01)

(52) U.S. Cl. ..... 422/61; 422/102; 436/43; 436/50; 436/174; 436/180; 702/19; 702/20; 702/22

(58) Field of Classification Search ..... 422/61, 422/62, 99, 102, 105; 436/37, 43, 50, 55; 702/19–23, 30; 700/92, 215, 266
See application file for complete search history.

(56) References Cited

U.S. PATENT DOCUMENTS

| | | | |
|---|---|---|---|
| 3,193,359 | A | 7/1965 | Baruch |
| 3,536,449 | A | 10/1970 | Astle |
| 3,556,731 | A | 1/1971 | Martin |
| 3,770,382 | A | 11/1973 | Carter et al. |
| 4,038,151 | A | 7/1977 | Fadler et al. |
| 4,116,775 | A | 9/1978 | Charles et al. |
| 4,118,280 | A | 10/1978 | Charles et al. |
| 4,224,278 | A | 9/1980 | Hogen Esch |
| 4,231,989 | A | 11/1980 | Thoma |
| 4,276,048 | A | 6/1981 | Leaback |
| 4,299,796 | A | 11/1981 | Hogen Esch |
| 4,318,994 | A | 3/1982 | Meyer et al. |
| 4,340,390 | A | 7/1982 | Collins et al. |
| 4,341,736 | A | 7/1982 | Drbal et al. |
| 4,420,566 | A | 12/1983 | Jessop et al. |
| 4,452,899 | A | 6/1984 | Alston |
| 4,495,149 | A | 1/1985 | Iwata et al. |
| 4,503,011 | A | 3/1985 | Hubeau |
| 4,554,839 | A | 11/1985 | Hewett et al. |
| 4,622,208 | A | 11/1986 | Namba et al. |
| 4,680,164 | A | 7/1987 | Kelin |
| 4,727,033 | A | 2/1988 | Hijikata et al. |
| 4,751,184 | A | 6/1988 | Higo et al. |
| 4,855,110 | A | 8/1989 | Marker et al. |

(Continued)

FOREIGN PATENT DOCUMENTS

| | | |
|---|---|---|
| WO | WO 98/39257 | 9/1998 |

*Primary Examiner*—Jill Warden
*Assistant Examiner*—Dwayne K Handy

(57) ABSTRACT

The present invention provides test trays and test tray systems for assessing the response of a biological sample to a compound or combination of compounds. The compounds or combinations are arranged in a factorial design in wells of the test tray, thereby facilitating the identification of optimal compound combinations and concentrations. The invention also provides methods of fabricating the test trays including the use of programmably controllable fluid dispensing devices. In addition, the invention provides methods of using the test trays and test tray systems to identify a preferred compound or compound combination, e.g., an optimum compound or compound combination.

35 Claims, 3 Drawing Sheets

U.S. PATENT DOCUMENTS 5,055,408 A 10/1991 Higo et al.
5,167,922 A 12/1992 Long
5,316,725 A * 5/1994 Carver et al. ..... 422/61
5,591,402 A 1/1997 Jones
5,591,642 A 1/1997 Jones
5,609,828 A 3/1997 O'Bear et al.
5,609,928 A 3/1997 Yedlin et al.
5,639,632 A 6/1997 Ericsson et al.
5,741,462 A * 4/1998 Nova et al. ..... 422/68.1
5,762,873 A 6/1998 Fanning et al.
5,766,533 A 6/1998 Mears et al.
5,800,778 A 9/1998 Chen et al.
5,932,177 A 8/1999 O'Bear et al.
6,004,617 A * 12/1999 Schultz et al. ..... 427/8
6,271,022 B1 * 8/2001 Bochner ..... 435/287.3
6,329,139 B1 * 12/2001 Nova et al. ..... 435/6
6,338,820 B1 1/2002 Hubbard et al.
6,682,702 B2 * 1/2004 Barth et al. ..... 422/102
2002/0023507 A1 2/2002 Freitag et al.
2002/0182721 A1 * 12/2002 Nishiguchi et al. ..... 435/299.1
2005/0084907 A1 * 4/2005 Fox ..... 435/7.1

* cited by examiner

TEST TRAY AND TEST SYSTEM FOR DETERMINING RESPONSE OF A BIOLOGICAL SAMPLE

FIELD OF THE INVENTION

The present invention relates to high density test trays and test systems employing such trays. The test trays and systems may be used to determine the response, e.g., sensitivity, of a biological sample to any of a plurality of compounds, conditions, and/or combinations thereof.

BACKGROUND OF THE INVENTION

The dramatic increases in lifespan that occurred during the $20^{th}$ century were due, in large part, to improvements in treatment and prevention of infectious diseases. Treatment encompasses the administration of pharmaceutical agents to patients infected with pathogenic bacteria, viruses, fungi, or protozoa. Prevention encompasses the deployment of a wide variety of techniques aimed at eliminating or reducing the number of pathogenic bacteria, viruses, fungi, or protozoa in the environment outside the body as well as prophylactic therapy. With the ever-increasing number of disinfecting agents and pharmaceutical compounds has come an increased need for methods of selecting an appropriate compound or combination thereof to combat a particular pathogen.

Frequently selection of an appropriate pharmaceutical agent or agents involves determining the response of a biological sample to the compound. For example, before prescribing an antibiotic for an infection it is desirable to know whether the infectious agent, e.g., a bacterium, fungus, virus, protozoan, etc., is sensitive to the antibiotic. Thus if the infectious agent is a bacterium, it may be desirable to know whether the antibiotic exerts a bacteriostatic or bacteriocidal effect on the bacterium. Predictions of sensitivity may be made based on the identity of the bacterium. However, the increasing prevalence of drug-resistant bacteria has made it increasingly important to assess sensitivity by directly contacting the bacterium with a candidate antibiotic. Similar considerations hold in the case of selecting an appropriate disinfecting agent.

Antibiotic sensitivity testing typically involves obtaining a biological sample presumed to contain the infectious agent. The sample, or a suspected pathogen or pathogens obtained from the sample, is then contacted with various compounds, and the response of the suspected pathogen is assessed. For example, the ability of a bacterium to multiply in the presence of the compound may be compared with the ability of the bacterium to multiply in the absence of the compound. Various techniques may be used to contact the suspected pathogen with candidate compounds. Traditionally, antibiotic susceptibility testing has often involved culturing infectious agents in relatively large vessels, receptacles, or trays into which appropriate culture medium, candidate compounds, and biological samples are placed. However, current test systems suffer from a number of drawbacks that limit their usefulness and flexibility for these and other applications. The present invention addresses some of these limitations.

SUMMARY OF THE INVENTION

The present invention provides test trays and test tray systems for assessing the response of a biological sample to a compound or combination of compounds. The compounds or combinations are arranged in a factorial design in wells of the test tray, thereby facilitating the identification of optimal compound combinations and concentrations. The invention also provides methods of fabricating the test trays including the use of programmably controllable fluid dispensing devices. In addition, the invention provides methods of using the test trays and test tray systems to identify a preferred compound or compound combination, e.g., an optimum compound or compound combination.

DETAILED DESCRIPTION OF CERTAIN EMBODIMENTS

I. Overview

Figure 1:
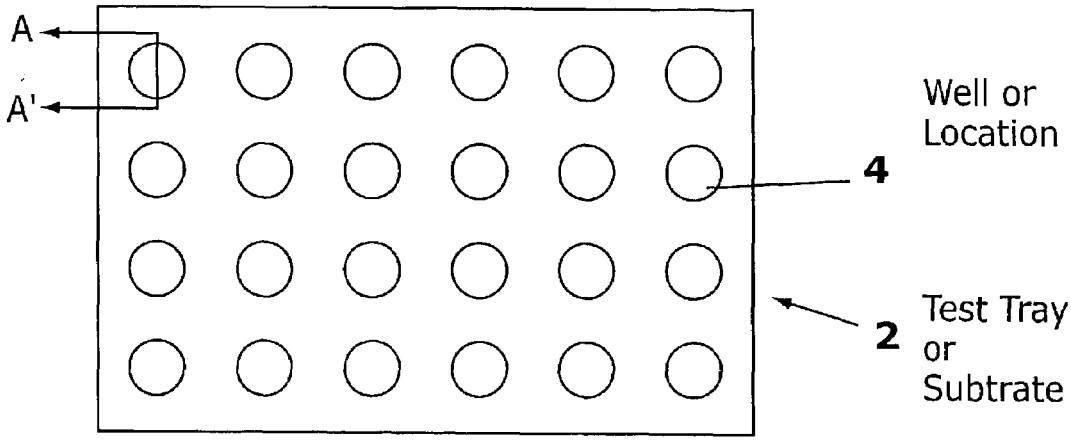
FIG. 1 is a schematic diagram showing a top view of an exemplary embodiment of the test tray.

In one aspect, the invention provides improved test trays and test tray systems for determining the response of a biological sample to a compound or combination of compounds. In particular, the invention provides a high density test tray for assessing the response of a biological sample to a plurality of compounds comprising a body having a surface with wells containing compounds, wherein the compounds are arranged according to a factorial design. According to various embodiments of the invention different factorial designs may be employed. In addition, the test tray may include elements such as a sealing element and/or an element that stores machine-readable information.

In another aspect, the invention provides methods for manufacturing and using the test trays of the invention. For example, the invention provides a method of fabricating a high density test tray comprising (i) providing a test tray having a high density of wells; selecting a factorial design, and (ii) dispensing a plurality of compounds into the wells using a programmably controllable fluid dispensing device, wherein the step of dispensing comprises dispensing the compounds according to the factorial design.

In another aspect, the invention provides a system for selecting a compound or compound combination to which a biological sample exhibits a desired response comprising (i) means for receiving a test tray having a plurality of wells, wherein the wells contain a compound or compound combination arranged according to a factorial design, and (ii) detection means for assessing the response of the biological sample to the compound or compound combination in each of the wells.

In another aspect, the invention provides improved methods for selecting an appropriate compound or combination of compounds to inhibit and/or destroy undesirable entities such as pathogenic microorganisms, cancer cells, etc. In particular, the invention provides a method of selecting a compound or compound combination to which a biological sample exhibits a desired response comprising (i) providing a test tray having a plurality of wells, wherein the wells contain a compound or compound combination arranged according to a factorial design, (ii) delivering the biological sample or a portion thereof to a plurality of the wells; and (iii) detecting the response of the biological sample to the compound or compound combination in each of the wells. According to certain embodiments of the invention the biological sample may comprise a microorganism, e.g., a bacterium, and compounds may be antibiotics or agents potentially useful as antibiotics. According to other embodiments of the invention the biological sample comprises cancer cells.

In another aspect, the invention provides a method of determining an optimal compound for eliciting a response from a biological sample, comprising (i) providing a test tray having a plurality of wells each containing a combination of reagents wherein the reagents are arranged according to a factorial design; (ii) applying a portion of the biological sample to each well; (iii) providing a test platform for receiving the test tray, the test platform coupled to a controller; (iv) installing the test tray into the test platform; and (v) activating the controller upon installing the test tray into the test platform, the controller performing an analysis based upon the factorial design.

In another aspect, the invention provides an automated system for detecting the response of a biological sample to a combination of reagents comprising (i) a test tray including a factorial matrix of test reagent mixtures; (ii) a test platform including a receiving portion for receiving the test tray; and (iii) a controller for controlling portions of the test platform upon installation of the test tray.

II. Test Tray Configuration and Features

The invention includes test trays for performing a plurality of assays on a population of cells or microorganisms (by which is meant either a bacterium, virus, fungus, or protozoan) and test systems to be used in conjunction with the test trays. According to certain embodiments of the invention the test trays contain at least 1,000 wells, each of which contains a test substance, i.e., a compound or a combination of compounds. According to certain other embodiments of the invention the test trays contain fewer than 1,000 wells, each of which contains a test substance, i.e., a compound or a combination of compounds. FIG. 1 is a schematic diagram showing a top view of an exemplary embodiment of a test tray 2 containing a plurality of wells 4. In certain embodiments of the invention the test tray contains at least 1,000 wells, at least 5,000 wells, at least 10,000 wells, at least 20,000 wells, at least 50,000 wells, or at least 100,000 wells. In certain preferred embodiments of the invention the wells are arranged in a rectangular array as shown in FIG. 1, but this is not a requirement, and any arrangement may be used. Section AA' is a cross-section through a well and is depicted in more detail in FIG. 2.

The overall dimensions of the test tray are on the order of centimeters or inches. For example, in certain embodiments of the invention the length and width of the test tray are less than approximately 6 inches (15 cm). In certain preferred embodiments of the invention the length and width of the test tray are less than approximately 2 inches (5 cm) or less than approximately 1 inch (2.5 cm). (Generally the term "approximately" as used herein will indicate that a number may vary by ±1%, ±5%, or ±10% depending upon the context.) In order to provide a large number of wells within this limited area, the density of the wells must be correspondingly high and the maximum dimensions of the length and width of the wells must be correspondingly small. Although referred to herein as "trays", they may take the form of cards, chips, etc.

The invention also includes various test systems for use in conjunction with the test trays. Exemplary test systems are described below.

A. Well Shape and Size

Generally the term "well" refers to a 3-dimensional depression or cavity that projects below a surface to form a vessel that is capable of containing a substance, typically a liquid. Alternately, walls of a well may project above a surface to form such a vessel. In certain embodiments of the invention the term "well" refers to any physical or chemical barrier (e.g., a hydrophobic barrier) that serves to confine a liquid to a discrete location. It is noted that although the test substances typically used with test trays and test tray systems of the invention will typically be liquids, solid materials may also be used. For purposes of description it is assumed herein that the test substances are liquids.

Figure 2:
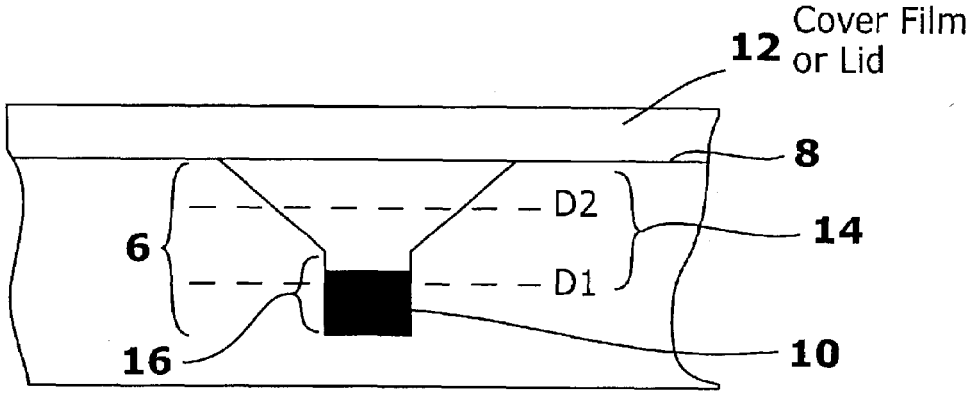
FIG. 2 is a schematic diagram showing a side view of an exemplary embodiment of one of the wells in a test tray.

FIG. 2 depicts cross-section AA' from FIG. 1 in more detail and shows a side view of an exemplary well in which the liquid-containing portion 10 projects downward from surface 12. The lower portion of liquid-containing portion 10 contains a compound solution 11, such as an antibiotic formulation. As shown in FIG. 2, the wells may be covered with a cover lid or film 6, which may be directly juxtaposed to the top of the well. This cover minimizes or eliminates the risk of spillage or cross-contamination of wells, e.g., during shipping and handling. In certain embodiments of the invention, however, there may be an intervening space between the top of the well and the cover.

Figure 3:
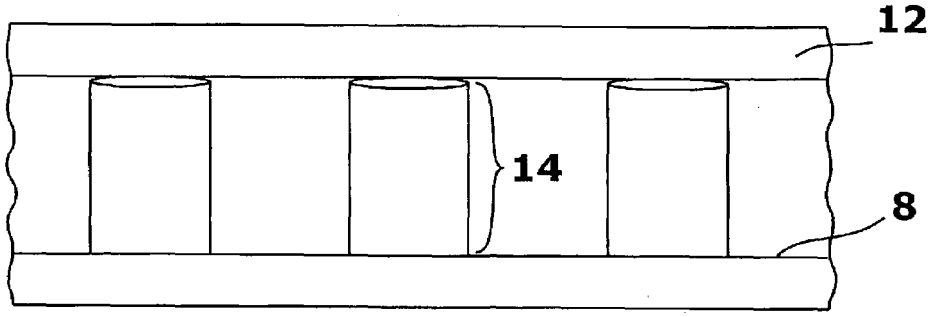
FIG. 3 is a schematic diagram showing a side view of a second exemplary embodiment of one of the wells in a test tray.

FIG. 3 shows a side view of a second exemplary well in which the liquid-containing portion 14 projects upward from surface 12. A well may have any shape or cross-section, where a "cross-section" is a section taken parallel or perpendicular to the surface from which the well projects. For example, the well may have a circular, oval, square, rectangular, or irregular cross-section. In certain embodiments of the invention the shape of the cross-section varies along the axis perpendicular to the surface below which the well projects.

As shown in FIG. 2, the area of a cross-section of parallel to the surface may vary with distance from the surface. For example, the area of a cross-section parallel to the surface may diminish with increasing distance from the surface. Thus a cross-section at depth D2 has a smaller area than a cross-section taken at depth D2 in FIG. 2. This configuration results in a well that has two portions: (1) an upper portion 14 closer to the surface from which the well projects; (2) a lower portion 16 further from the surface from which the well projects. In certain preferred embodiments of the invention at least the lower portion of the well has capillary sized dimensions. For example, the dimensions may include a hydraulic diameter not greater than 2 millimeters and preferably a hydraulic diameter of less than 1 millimeter. Such a well configuration may be advantageous in that it allows the antibiotic formulation to occupy the narrower, capillary portion of the well. Capillary action will tend to cause the antibiotic formulation to remain in the narrower portion of the well, thus reducing the likelihood of spillage or cross-contamination of wells during movement of the test tray.

The shape of a parallel cross-section may also change with increasing distance from the surface. For example, as shown in FIG. 2, the shape of the cross-section may change (either abruptly or smoothly) from circular (as at depth D1) to square (as at depth D2). A funnel-shaped upper portion as depicted in FIG. 2 may be advantageous in that the forces of gravity will facilitate collection of the test substance and/or other components in the lower portion of the well. Alternatively, the sides of the well may be tapered, resulting in a cone-shaped well.

As mentioned above, the dimensions of the well are small in order to accommodate a large number of wells in a tray with a small surface area. Typical well volumes may be in the picoliter, nanoliter, or microliter range. In preferred embodiments of the invention the volume of each well is less than approximately 100 microliters. The dimensions of the well will necessarily vary depending upon the particular shape.

B. Compounds

In general, the test tray may be used to assess the effect(s) of any test substance, i.e., any compound or combination of compounds on a biological sample. As used herein, the term "antimicrobial" refers to compounds that exert an inhibitory effect on the ability of a bacterium, virus, fungus, or protozoan to replicate or survive when present in the environment of the bacterium, virus, fungus, or protozoan at a concentration consistent with the purpose for which the antibiotic is used. For example, if an antimicrobial is used to treat a human or animal subject, a consistent concentration would be a concentration within an accepted therapeutic window, e.g., a concentration below that at which unacceptable toxicity to the subject occurs.

The term "antibiotic" refers to antimicrobials suitable for administration to a human or animal subject to treat or prevent a bacterial, viral, fungal, or protozoal infection. The term includes pharmaceutical compounds approved by an appropriate government agency for treatment of human subjects. For example, pharmaceutical compounds approved for human use in the United States are listed by the Food and Drug Administration (FDA) under 21 C.F.R. §§ 330.5, 331-361, 440-460, and pharmaceutical compounds for veterinary use are listed by the FDA under 21 C.F.R. §§ 500-582, all of which are incorporated herein by reference, are all considered acceptable for use in the test trays of the invention.

According to certain embodiments of the invention the antimicrobial is an active ingredient found in a disinfectant, sterilizer (sporocide), or sanitizer. Classes of active ingredients include, but are not limited to, (1) heavy metals (e.g., mercury, silver, arsenic), which cause protein denaturation; (2) halogens (e.g., chorine, iodine, hypochlorite), which include oxidizing agents and household bleach; (3) phenols and cresols, which can dissolve membranes and denature proteins; (4) alcohols; (5) ethylene oxide. See the Web site having URL www.epa.gov/pesticides for registration listings of antimicrobials approved for use in the U.S. and their active ingredients.

As used herein, the term "biological sample" may refer either to (1) a biological material obtained from a subject, such as tissue, cell(s), blood, urine, feces, saliva, etc., which may or may not be cultured in vitro, and which may or may not be combined with additional materials such as culture medium; (2) a biological entity such as a bacterium, virus, fungus, protozoan, cell, etc.; or (3) any material containing a biological entity such as a bacterium, virus, fungus, protozoan, cell, etc.

C. Other Components

In addition to one or more test compounds, the wells may contain any of a variety of other components. In some embodiments of the invention the wells contain an indicator that may interact directly or indirectly with the biological sample or with a product of the biological sample and may convey information regarding the state of the biological sample. The indicator may provide information regarding one or more parameters of the biological sample, e.g., cell viability, proliferation, metabolic and/or biosynthetic activity. For example, the wells may contain a component that indicates cellular activity such as a substrate that is metabolized by a cell, a substance that reacts with a metabolic product of the cell or that reflects an alteration such as a pH change resulting from cellular activity. In general, an alteration in the state of the component is indicative of the state of the biological sample. The state of the component may serve as a surrogate for the state of the biological sample, allowing the state of the biological sample to be more readily determined. In certain embodiments of the invention the component and/or a change in the state of the component is readily detectable. Molecules that are fluorescent or luminescent are particularly useful in this regard. The component may be a compound such as a dye that is differentially taken up by cells in different physiological states.

D. Information Storage Device

In certain embodiments of the invention the test tray includes an information storage device that stores information such as information indicative of various aspects of the test tray. Examples of suitable information storage devices include memory devices (such as ROMs, EEPROMSs, RAMs, write once, read/write, etc.), magnetic storage (such as magnetic stripes), optical coding (such as laser readable coding or bar coding), non-contact (RF, inductive, or capacitively coupled) devices, and conventional storage methods. The stored information may include, but is not limited to, the following:

(i) The particular test matrix being run, or an identifier of the test matrix. This enables the test system (into which the test tray is installed) to provide the proper software algorithm for evaluating results of the test and eliminates the need for selection the particular software algorithm required. In general, selection of the appropriate software algorithm would require knowledge of experimental design mathematics. Storing the matrix information in association with the test tray reduces the effort and expertise needed to use the test tray and also eliminates the possibility of erroneous entry of information concerning the test tray.

(ii) An expiration date. This enables the test system to provide a warning or even reject results from the test tray in the event that the test reagents are beyond their shelf life. At the very least the operator will be aware that the test results may be suspect.

(iii) A code indicative that the tray has been used. An operator might inadvertently use a previously used tray. In such an event, the test system can alert the user that the tray is contaminated. In certain embodiments of the invention this information is stored in a write once memory portion.

(iv) Information from the test system indicative of test results. Storing the results in association with the test tray may reduce the need for record keeping and for consulting records of results. Thus in certain embodiments of the invention the information storage device includes a portion of memory for receiving information from the test system. This may, but need not be, a write once portion. An operator can simply read the results directly from the information storage device either using the test system or a stand-alone reading device. In addition, storing test results in association with the test tray provides a backup system in the event that other storage systems fail or are unavailable. Another advantage might be in the case of a multi-staged experiment in which the test tray is incubated several times and the data is collected several times. The test system would record additional information on the memory device such as information indicative of the time at which various measurements were made and the results obtained. This might be useful in the event that the tray is installed in different test systems over time, e.g., test systems with different detection capabilities. Of course, the test results and/or additional information could also be stored on the test system.

The results may include, but are not limited to: (1) output of test system detection device; (2) cell density; (3) organism identified, etc.

(v) Other information including, but not limited to: (1) the nature or characteristics of the biological sample, e.g., whether it is blood, saliva, etc., (which may be useful in interpreting the test results); (2) source of sample, e.g., patient ID; (3) information about a patient, which may include a patient ID, so that the results may be appropriately correlated with the patient from whom the sample was obtained; (4) test tray serial number or lot number; (5) whether sample contains biohazardardous material/organisms (which may indicate that extra caution is needed when handling or disposing of the test tray); (6) time elapsed since testing began or until testing will be completed; (7) conditions monitored during the test (which may include, for example, temperature, pH, oxygen or nutrient concentration, etc. This information may be helpful in interpreting test results or in designing additional experiments).

In certain embodiments of the invention the test tray includes a bar code that encodes information about the test tray. The bar code can be read by a standard bar code reader, which may be incorporated into the test system and may store any of the types of information described above. Additional bar code(s) can be added to the test tray by the user. For example, it may be desirable to add a bar code encoding patient identification information, date on which biological sample was added to the test tray, etc.

In general, information stored in the information storage device may be read by the test system or by an independent reader. The information may be displayed on a screen, printed out, transferred to another device, etc.

III. Test Tray Fabrication

A. Materials and Manufacturing Techniques

The test tray may be manufactured from a variety of materials including plastics (e.g., polystyrene, polycarbonate, polypropylenes, acrylates, etc.), silicon oxides (e.g., glass), ceramics, semiconductor materials, composites, and combinations of any of these. Preferred materials are biocompatible or are coated with a biocompatible material. Standard manufacturing techniques appropriate for the respective materials may be used to manufacture the test tray and the wells. These techniques include, but are not limited to, photolithography, stamping techniques, pressing, casting, molding (e.g., injection molding), microetching, electrolytic deposition, chemical or physical vapor deposition employing masks or templates, electrochemical machining, laser machining or ablation, electron beam machining or ablation, and conventional machining. U.S. Pat. No. 6,197,575 describes various manufacturing techniques that may be used to fabricate the test trays.

The test tray may consist of multiple layers of different materials, which may be joined by adhesives or deposited upon one another (e.g., by chemical vapor deposition, physical vapor deposition, and electrodeposition). For example, a silicon wafer (which may be mounted on a rigid substrate such as glass or plastic) may be used to form a layer, which can then be etched to form wells. Alternatively, one or more additional layer(s) of semiconductor materials such as silicon nitride may be deposited on the lower layer(s) and then etched.

Selection of an appropriate material and manufacturing technique may depend on the particular dimensions, density, and volume of the wells. For example, when the dimensions of the wells (length, width, depth) are of the order of 1 mm in size, injection molding is a suitable method. When the well dimensions are less than approximately 100 microns, then etching into glass or silicon may be preferable to achieve appropriate dimensional control.

B. Dispensing Antibiotic Compounds and Other Components

Compounds and other components may be dispersed into the wells using any of a variety of methods. For example, commercially available automated liquid handling devices, e.g., programmably controllable fluid dispensing devices, may be used. These include, but are not limited to, devices such as the SYNQUAD 5500™ liquid handling robot (available from Cartesian Technologies, Inc. of Irvine, Calif.). In one embodiment of the present invention, the elements of the microarray are formed by depositing small drops of each compound or agent into the appropriate well(s). Typical drop sizes may range in volume from approximately 0.1 to approximately 100 nl; however, smaller and larger volumes may be used.

In another embodiment of the invention drops may be deposited into the wells using a microarray of pins (e.g., ChipMaker2™ pins, available from TeleChem International, Inc. of Sunnyvale, Calif.). A range of pins exist that take a sample volume up by capillary action and deposit a spot volume of 1 to 10 nl. In another embodiment, the drops may be deposited into the wells using syringe pumps controlled by micro-solenoid ink-jet valves that deliver volumes greater than about 10 nl (e.g., using printheads based on the SYNQUAD™ technology, available from Cartesian Technologies, Inc. of Irvine, Calif.).

In certain preferred embodiments of the invention a microdispensing system such as a printing system having a drop on demand printhead is used to place very small quantities of the compounds into the wells. The drop volume range for inkjet printing systems ranges between approximately 200 picoliters ($200\times10^{-12}$ liter) down to less than one picoliter. Alternatively, the drops may be deposited using piezoelectric inkjet fluid technology that deposits drops with volumes between about 0.1 and 1 nl (e.g., using the MICROJET™ printhead available from MicroFab Technologies, Inc. of Plano, Tex.).

One advantage of drop on demand jetting is the large dynamic range of possible volumes—printheads can eject fluids at frequencies of between 1,000 and 50,000 hertz per nozzle and have between 10 and 2000 nozzles. Thus drop on demand printing is admirably suited to rapid production of compound-containing test trays. For example, according to certain embodiments of the invention one or more nozzles of a printhead is dedicated to each of a plurality of different compounds. Thus it is possible to achieve high purity and reproducibility of compound concentrations as opposed, for example, to using a single delivery device for a plurality of different compounds and cleaning the device when switching between different compounds. Another advantage of drop on demand printing is the ability to readily fabricate custom trays. For example, according to certain embodiments of the invention multiple compounds are dispensed simultaneously. A third advantage is the ability to easily fabricate factorial design matrices, as described below.

In certain embodiments of the invention the compounds and/or components are provided as stock solutions, i.e., solutions having a higher concentration than the final concentration desired in the wells. The appropriate concentration and solvent for a stock solution will vary depending upon the particular compound or agent. Once the stock solutions have been prepared, a predetermined volume of each stock solution may be placed in the separate reservoirs of a robotic liquid handling device, ink-jet printing device, etc.

In preferred embodiments of the invention, a compound or combination of compounds is placed into each well of the test tray. The compound(s) or combinations thereof may be arranged in accordance with factorial design principles. The concentrations of different compounds may be varied by altering the number of drops of the compound. In embodiments of the invention in which the tray is to be provided with compounds in liquid or frozen liquid form, the volume in the wells may be augmented by adding a solvent so that each well contains the same volume. The relative amount of compound and solvent to be placed into each well is determined based on the desired final concentration of compound.

In certain embodiments of the invention the test trays are to be provided, e.g., to a customer, with the compounds and components in dry form, e.g., dessicated or lyophilized. In this case the compounds and components may be reconstituted prior to or at the same time as the cells are added to the wells. Reconstitution may be performed by adding an appropriate solvent (e.g., water) prior to addition of cells or simply by adding cells in a liquid medium such as blood, saliva, cell culture medium, etc.

One aspect of the present invention involves the recognition that a virtually infinite number of combinations of compounds can be obtained according to the present invention by varying the compositions of the stock solutions that are initially provided to the dispensing apparatus robotic and/or by providing different numbers of drops taken from these stock solutions. The combinations may vary in that they contain different antibiotic compounds and/or in that they contain different concentrations of the same antibiotic compounds. For example, if three different antibiotic compounds are used and each compound may be present in a combination at any of two different concentrations, then there is a total of nine ($3^2$) different combinations. If three different antibiotic compounds are used and each compound may be present in a combination at any of three different concentrations, then there is a total of nine ($3^3$) different combinations. In accordance with factorial design terminology (see below), each compound is a factor; each concentration is a level; and each combination is a treatment.

Once the compounds have been dispensed into the wells, a cover lid or film may be placed over the wells to reduce spillage and contamination. The tray may incorporate a sealing element such as a sealed lid and/or shrink-wrap comprising a material such as a plastic film. The tray may be sterilized, either before or after addition of the compounds, e.g., by autoclaving, exposure to radiation (e.g., UV, X rays, gamma rays, etc.), liquid or gas sterilization (e.g., with cyanide), ion beam sterilization, etc. If sterilization is performed after the compounds are dispensed, the sterilization technique is preferably one that does not reduce the potency of the compounds.

C. Factorial Design

In many situations multiple factors or variables may affect the response of a phenomenon being studied. It is frequently of interest to determine the effect of such factors on the response. The present invention offers improved methods and accompanying apparatus for determining the effect of different factors on the response of a biological sample. The following definitions are provided to facilitate the description herein:

Experimental Design: A plan for collecting and analyzing data to answer a question relevant to the needs of the experimenter. Also used to mean a set of runs to be run as a unit. In the context of a test tray, each usage of the test tray involves a set of runs, with each run corresponding to a well.

Factors: Input variables in an experiment (which may be qualitative or quantitative).

Interactions: An effect of interaction occurs when a relation between (at least) two factors (variables) is modified by (at least one) other factor. In other words, the strength or the sign (direction) of a relation between (at least) two variables is different depending on the value (level) of some other variable(s).

Level: Any of the possible values that a particular factor can assume.

Main effect: The simple effect of a factor on a dependent variable, independent of any interaction with other factors, i.e., the effect of the factor alone averaged across the levels of other factors.

Replicates: A single trial can be run several times; these runs (all of one trial) are called replicates of that trial. In the context of the test trays, multiple replicates can be performed with a single tray since results from each well may be considered a run.

Run: The result of actually performing a trial and obtaining data. In the context of the test trays, results from each well may be considered a run.

Treatment: A combination of levels of the factors.

Trial: A plan for conducting an experiment which includes a level chosen for each factor.

In the context of the present invention, an experiment includes the process of exposing a biological sample to a compound or combination of compounds in a well and determining the response of the sample. Relevant factors include, but are not limited to, the identity of particular compound(s) in a well. Other factors may include temperature, growth medium, gas concentration, etc. In general, factors may exhibit a range of different levels (e.g., concentrations).

One approach to the problem of determining how different factors affect an outcome is known as the "one factor at a time" (OFAT) approach. In a typical experiment employing an OFAT experimental design the experimenter sets up multiple runs, in which one factor is varied in each run while holding the other factors constant. Such an approach has a number of limitations. In particular, (1) for another combination of values for the other factors the effect of the single factor may change; (2) interactions between factors cannot be measured; (3) as the number of factors increases the number of runs can become very large. A second "brute force" approach involves performing multiple runs in which one or more factors is varied and comparing the results with a control. This approach (1) does not test interactions between factors; and (2) requires a great deal of testing.

The present invention provides test trays whose wells contain predispensed compounds and compound combinations. The compounds are predispensed in a range of concentrations, where the concentrations and combinations of compounds are selected in accordance with a preselected factorial experimental design. An appropriate biological sample is added to the wells, and the response of the biological sample to the compound(s) in the well is assessed. The results are analyzed using a computer program selected to correspond with the particular factorial design embodied in the test tray. In certain preferred embodiments of the invention the test tray includes identifying indicia that identify the factorial design embodied in the test tray. Such indicia may be provided by various means, e.g., bar code, readable memory, etc. Preferably the indicia are machine-readable, e.g., by a test system that also includes modules to assess the response of the biological sample. The invention thus greatly facilitates the process of performing factorial design experiments.

The term "factorial design" or "factorial matrix design" refers to an experimental design for testing the effects of multiple factors on one or more output responses by performing multiple runs in which the factors are varied simultaneously in different runs and the responses are compared. A factorial design can be used to evaluate the effect of two or more factors simultaneously, i.e., for testing the effects of multiple factors on one or more output responses of an experiment by simultaneously varying the factors for which this response is to be determined. Stated another way, a factorial design is a number of matrix points wherein each matrix point is a particular combination of setpoints (levels or values) for the factors. Each factor is varied over a limited number of extreme and perhaps intermediate points for the matrix points. In general, the effects of N factors can be determined with M experimental matrix points where M is can be as low as N+1 for main effects experiments and as low as $2^N$ for linear interaction experiments. Among the advantages of factorial designs over one-factor-at-a-time experiments are (1) they are generally more efficient; and (2) they allow interactions between factors to be detected.

The definitions and understanding of factorial designs provided above may also be stated in the following more formal terms, which are adapted from Raktoe, B., et al., "Factorial Designs", Wiley, New York: 1981. In the discussion below mathematical symbols are to be given the meanings that are standard in the art unless otherwise indicated.

ith factor. Consider t nonempty, not necessarily distinct sets $G_1, G_2, \ldots G_t$ with cardinalities (i.e., with number of elements) $k_1, k_2, \ldots, k_t$, respectively, such that $k_i>1$ for all i. With each set $G_i$, is associated a formal symbol $F_i$, which is referred to as the ith factor. For example, each symbol $F_i$ may represent a compound whose effects on a biological sample are to be determined. Although in general t may be equal to 1, for purposes of the present invention t is greater than 1. levels of the ith factor. The elements of $G_i$, when associated with the formal symbol $F_i$, are called the levels of the ith factor. The levels of a factor are the possible levels specified by the experimenter at which an experiment can be conducted. However, this does not mean that all of them are used in any particular experiment. For example, in an experiment in which a factor is a compound whose effect on a biological sample is to be assessed in the experiment, the levels may be a set of possible concentrations falling within some range.

factor space: The factor space, G, is the Cartesian product of the $G_i$, i.e., $G=X_{i=1}^{t} G_i$, where the symbol X denotes the Cartesian product, where the Cartesian product is the collection of all ordered n-tuples that can be formed so that they contain one element of the first set $G_1$, one element of the second set $G_2, \ldots$, and one element of the n-th set $G_n$. G is to be understood to mean the set G together with the associated factors $F_1, F_2, \ldots F_t$. Thus in an experiment in which a factor is a compound whose effect on a biological sample is to be assessed in the experiment, the set G would include an element corresponding to each combination of compounds at each possible concentration for that compound. For example, if two compounds F1 and F2 are to be tested, and if F1 is to be tested at concentrations c1, c2, and c3, and F2 is to be tested at concentrations c4, c5, and c6, the set G is {(c1, c4), (c2, c4), (c3, c4), (c1, c5), (c2, c5), (c3, c5), (c1, c6), (c2, c6), (c3, c6)} and is associated with factors F1 and F2.

factorial design: A factorial design (or factorial arrangement) with parameters $k_1, k_2, \ldots, k_t$, m, n, $r_1, \ldots, r_N$, m>0 and $n=\Sigma_{j=1}^{N} r_j>0$, is a collection of n treatments of G such that the jth treatment in G has multiplicity $r_j \geqq 0$ and m is the number of nonzero $r_j$. Such a factorial design may be concisely represented by the symbol FD ($k_1, \ldots, k_t$; m; n; $r_1, \ldots, r_N$). In the context of an experiment in which a factor is a compound whose effect on a biological sample is to be assessed using a test tray with compound-containing wells, each treatment is a particular combination of compound(s) and concentrations. Multiplicity refers to the number of wells having identical contents in terms of compound(s) and concentrations.

treatment: Each element g of G is referred to as a treatment. For example, in the experiment described above in which the factors F1 and F2 are compounds whose effect on a biological sample is to be assessed in the experiment, a treatment defines a concentration for F1 and a concentration for F2. Thus the treatments are (c1, c4), (c2, c4), (c3, c4), (c1, c5), (c2, c5), (c3, c5), (c1, c6), (c2, c6), and (c3, c6) where the first element of each ordered pair is a concentration at which F1 is present in a well and the second element of each ordered pair is a concentration at which F2 is present in the well with the concentration of F1 corresponding to the first element of that ordered pair.

The test trays can contain compounds and concentrations selected in accordance with any of a wide variety of factorial designs. The results obtained by using the test tray are analyzed using a software program that contains analysis code corresponding to the particular factorial design employed in the test tray. The software analyzes the data to obtain values for parameters corresponding to an appropriate model that expresses the response in terms of the parameters and the factors (variables). As will be evident to one of ordinary skill in the art, parameters can typically be obtained for any particular model using any of a variety of different factorial designs (though not all factorial designs will be suitable for a given model). However, the choice of a factorial design typically constrains the set of distinct models for which parameters can be obtained. For example, results obtained using a minimal factorial design suitable for obtaining parameters to fit a first order polynomial equation cannot in general be used to obtain parameters to fit a higher order polynomial equation. In certain embodiments of the invention the software allows the user to select a desired model and obtains parameters for that model based on the results obtained from the factorial design experiment.

In general the information provided by the parameters depends upon the particular model. Certain parameters of the model typically provide information regarding the independent effect of each factor. Other parameters typically provide information regarding interactive effects of multiple factors. In the context of a test tray application in which the user desires to select an optimum combination of compounds and compound concentrations, the values of the parameters allow the user to determine the effect of varying the concentration (s) and/or identities of the compounds. In certain embodiments of the invention the software provides the following types of information for a typical test tray experiment: (1) the results (output or outputs) for each run and each trial, (2) standard deviations for each trial; (3) the pooled standard deviation(s) for multiple trials, (4) an equation relating inputs to outputs, (5) recommended ranges or values of factors (e.g., compound concentrations), (6) contour plots indicating sensitivity to various factors (concentrations), etc. Typically, the result of a trial is the average over the runs that make up the trial. The equation is obtained by fitting the experimental results to an appropriate model as described further below. In order to reduce potential bias that may result from performing runs in a particular order, the runs may be performed in a random order. This may, for example, be accomplished by positioning the test tray appropriately within the test system so that results from the wells are detected in a random order rather than in an order that is related to the position of the well on the test tray. Other means for ensuring a random order may also be used. For example, multiple detectors may be positioned so that different detectors detect results in different wells, and the sequence in which the detectors detect results may be selected randomly. According to certain embodiments of the invention selection of a random order is performed with the aid of a random number generator. The system may include code to control the positioning of the wells and/or the order of detection so as to ensure a random order of detection. This feature may be provided as an option to the user.

The following sections describe some examples of factorial designs that may be employed and considerations associated with their use. One of ordinary skill in the art will appreciate that it is not possible to list or enumerate all possible factorial designs. However, the information provided above concisely defines factorial designs, and any test tray whose treatments embody a factorial design fall within the scope of the invention.

There are several advantages in terms of statistical precision and inference from using all possible treatments, i.e., all combinations of all levels of the various factors under study. Such a design is referred to as a complete factorial. In more formal terms, a factorial design is a complete factorial design if $r_j>0$ for all j. However, as the number of factors and/or number of levels increases, the number of possible combinations can become very large. Constraints such as available space, quantity of experimental sample, time to set up and perform experiment, etc., may limit the number of combinations of levels that can be feasibly evaluated. In such situations it may be preferable to use a subset of the complete factorial, referred to as a fractional factorial, in which not every possible combination of levels is evaluated. In more formal terms, a factorial design is referred to as a fractional factorial design if some but not all $r_j>0$. The compounds may be dispensed in accordance with either a complete or a fractional factorial design. The factorial design may include replicates of one or more of the treatments. The number of replicates may vary (e.g., from between 2 and 10, greater than 10, greater than 100, etc.) and need not be the same for each treatment. As will be evident, including multiple replicates improves the statistical significance of the results.

In certain embodiments of the invention a factorial design suitable for use in evaluating parameters in a mathematical model such as the following is used. In formal terms, such a model associated with a factorial design Γ may be expressed in terms of a relationship of the form $$E[Y_g] = \sum_{i=0}^{k-1} f_i(g)\theta_i = f'(g)\theta'$$

for each g in G, where $f'(\bullet)=(f_0(\bullet), f_1(\bullet), \ldots, f_{k-1}(\bullet))$ is a vector of k real known functions defined on G and $\theta'=(\theta_0, \theta_1, \ldots, \theta_{k-1})$ is a vector of k unknown parameters. $Y_g$ is a random variable associated with each treatment g and is called an observation, response, or measurement. The set of parameters $\theta_0, \theta_1, \theta_{k-1}$, is referred to as the set of factorial effects. The vector θ reflects the behavior of $E[Y_\Gamma]$ with respect to changes in the levels of the factors.

In matrix notation, the above model for any factorial design Γ may be written as follows:

$$E[Y_\Gamma]=W_\Gamma\theta$$

where the element in the gth row and jth column of $W_\Gamma$ is equal to $f_j(g)$ and E(•) is the expectation operator. The orthogonal polynomial model and the Helmert polynomial model are two examples of models that may be used.

Certain preferred factorial designs include designs that can be used to evaluate parameters in one or more models whose formulas are given below for the three factor case, where the three factors are designated $x_1$, $x_2$, and $x_3$. Similar formulas for cases with different numbers of factors are readily evident to one of ordinary skill in the art.

Linear Model:

$$y=b_1 x_1+b_2 x_2+b_3 x_3$$

Quadratic Model:

$$y=b_1 x_1+b_2 x_2+b_3 x_3+b_{12} x_1 x_2+b_{13} x_1 x_3+b_{23} x_2 x_3$$

Special Cubic Model:

$$y=b_1 x_1+b_2 x_2+b_3 x_3+b_{12} x_1 x_2+b_{13} x_1 x_3+b_{23} x_2 x_3+ b_{123} x_1 x_2 x_3$$

Full Cubic Model:

$$y=b_1 x_1+b_2 x_2+b_3 x_3+b_{12} x_1 x_2+b_{13} x_1 x_3+b_{23} x_2 x_3+ d_{12} x_1 x_2 (x_1-x_2)+d_{13} x_1 x_3 (x_1-x_3)+d_{23} x_2 x_3 (x_2-x_3)+b_{123} x_1 x_2 x_3$$

The following description relates to a factorial design test tray that can be used to select a preferred antibiotic composition to inhibit growth of a bacterium. For illustrative purposes the description pertains to a test tray having 16 wells, each containing one of two possible concentrations (levels) of one of three antibiotic compounds (factors): $X_1$, $X_2$, and $X_3$. The test tray design includes one repetition, i.e., each set of levels for $X_1$, $X_2$, and $X_3$ appears in two wells. It is to be understood that an actual embodiment of the test tray would contain many more wells, offering the potential for testing many more compounds and concentrations and including many more repetitions. In addition, the test tray may have multiple wells whose contents vary only with respect to the culture medium, which can be considered an additional factor.

| Well | X1 | X2 | X3 | Result |
|---|---|---|---|---|
| 1 | −1 | −1 | −1 | 1.55 |
| 2 | −1 | −1 | +1 | 0.95 |
| 3 | −1 | +1 | −1 | 0.51 |
| 4 | −1 | +1 | +1 | 0.47 |
| 5 | +1 | −1 | −1 | 1.25 |
| 6 | +1 | −1 | +1 | 0.86 |
| 7 | +1 | +1 | −1 | 0.35 |
| 8 | +1 | +1 | +1 | 0.32 |
| 9 | −1 | −1 | −1 | 1.45 |
| 10 | −1 | −1 | +1 | 0.92 |
| 11 | −1 | +1 | −1 | 0.48 |
| 12 | −1 | +1 | +1 | 0.50 |
| 13 | +1 | −1 | −1 | 1.22 |
| 14 | +1 | −1 | +1 | 0.84 |
| 15 | +1 | +1 | −1 | 0.39 |
| 16 | +1 | +1 | +1 | 0.31 |

In the above table, −1 represents a low concentration of compound (e.g., 1 ug/ml) while +1 represents a high concentration of compound (e.g., 50 ug/ml). The numbers in the Result column represent a measure of bacterial growth, e.g., optical density. The data can be analyzed with regression analysis, using the following formula:

$$Y=A_0+A_1*X_1+A_2*X_2+A_3*X_3+A_{12}*X_1*X_2+A_{13}*X_1*X_3+A_{23}*X_2*X_3+A_{123}*X_1*X_2*X_3.$$

Evaluation of the parameters $A_0$, $A_1$, $A_2$, $A_3$, $A_{12}$, $A_{13}$, $A_{23}$, and $A_{123}$ allows the determination of main effects ($A_1$, $A_2$, and $A_3$) as well as second order interaction effects ($A_{12}$, $A_{13}$, and $A_{23}$) and third order interaction effects ($A_{123}$).

As an example of interaction effects, consider a test tray in which each well contains ten compounds, $X_1$ through $X_{10}$, at any of a number of possible concentrations. identical concentrations. The biological sample contains bacteria, and the response to be determined is bacterial growth, measured by bacterial count, which can be determined from optical density. Suppose $X_3$ is a compound that alters the bacterial cell wall, increasing its permeability to certain molecules, but does not by itself inhibit bacterial growth. Suppose $X_7$ is a compound that inhibits bacterial growth when present within the cell, but that the cell wall is impermeable to $X_7$. The following formula describes the response Y. Terms involving compounds other than $X_3$ and $X_7$ are omitted for the sake of simplicity.

$$Y\text{ (bacterial count)}=B_0+B_3*X_3+B_7*X_7+B_{37}*X_3*X_7+\text{other terms involving the remaining factors.}$$

The test system gathers optical density data at various times. The identity of the factorial matrix design is provided to the software (e.g., it may be read from the test tray as described elsewhere herein). The software determines the values of the parameters in the above equation using the optical density. $B_0$ will be approximately equal to the bacterial count if no compound is provided. $B_3$ and $B_7$ would be close to zero, since neither compound $B_3$ nor compound $B_7$ can effectively kill the bacteria alone. The $B_{37}$ term would be a fairly large negative number, e.g., approximately equal to taking B0 and dividing by the maximum concentrations of $X_3$ and $X_7$ and multiplying by −1. The large magnitude of $B_{37}$ reflects the fact that compounds $X_3$ and $X_7$ interact. This information would be provided by the software to the user.

A design that finds particular use in screening applications, especially where there is a large number of factors, is referred to as a Plackett-Burnam design. Another useful factorial design is referred to as the uniform shell design. Numerous other factorial designs may be used. Representative examples are described, e.g., in Montgomery, D., *Design and Analysis of Experiments*, John Wiley & Sons, Inc., 2000 and the Web site having URL www.statsoftinc.com/textbook/stexdes.html#2 (the Electronic Statistics Book, Statsoft) accessed Aug. 1, 2002.

It will be appreciated that in the high density test tray systems of the invention it is possible to include multiple repetitions of any given trial or trials. According to certain embodiments of the invention the factorial design includes at least one repetition for each of a plurality of trials. In various embodiments of the invention the number of repetitions for any particular trial may vary from 2 to 100 or more, including all numbers within this range. In various embodiments of the invention at least one repetition is included for at least 5% of the trials, ranging up to 100% of the trials and including all percentages within this range. In a design that includes multiple repetitions for one or more trials, the number of repetitions need not be identical for different trials.

IV. Test Systems

The test systems for use with the inventive test trays typically include a receiving module for receiving a test tray; sensor/detector modules for monitoring the state of the biological sample; various test tray positioning and transferring systems; a central processing unit (CPU) programmed with appropriate software for controlling the activities of the test system; and one or more input/output modules that allow a human user to enter information or receive information from the test system. The input/output modules typically include a user interface that allows a user to enter and receive information and a software program for transferring and processing information received from the user or from sensors within the test system, etc. Information may be entered using a variety of approaches, e.g., buttons, touch screen, etc. Information may be displayed on a screen, printed, stored, transferred to another system such as a patient record system, etc.

Depending on the level of integration, the test tray system may include a biological sample loading module for dispensing the biological sample into wells. This module may include devices for diluting and pipetting samples and/or culture medium. In certain embodiments of the invention the test system includes an incubation module. In such a highly integrated system the user may supply the biological sample, e.g., in a test tube, and the system performs appropriate dilution and distribution functions to dispense the sample into the wells of one or more test trays. The test tray remains within the test machine for subsequent steps, thus minimizing required technician time. The various functions may be performed according to instructions entered by the user.

Various standard processing sequences may be programmed into the system, and the user may select a desired processing sequence from among these. The test tray may be maintained under appropriate environmental conditions (e.g., temperature, humidity, etc.) in an incubation chamber within the test system during the course of the test. The state of the biological sample in each well is monitored either intermittently or continuously. Typically each well is monitored intermittently, which will generally require moving the test tray relative to the sensor/detector modules, which may be accomplished either by moving the test tray or by moving the sensor/detector modules.

The test tray positioning and transferring systems ensure that the test trays are in an appropriate location relative to various components of the system. For example, a test tray positioning/transferring system typically moves the test tray from the receiving module to, e.g., a one element of the test tray positioning system may place the test tray in an appropriate relationship to the sensor/detector modules to allow accurate data gathering thereby. The sensor/detector modules may contain transmittance and fluorescence optics and processing circuitry to gather transmittance and fluorescence data from the wells and to transfer the data, e.g., to a central processing unit.

According to certain embodiments of the invention the test system includes software (code) to analyze the data gathered by the sensor/detector modules. Preferably the software includes code for analyzing results of a factorial design experiment. To process data corresponding to a particular test tray, the program receives input information identifying the factorial design employed in the test tray. This information may be contained in a bar code or memory device provided as a part of the test tray or may be entered by a user.

Of course test systems for use in conjunction with the test trays need not contain all the features described above. For example, it is not necessary that the test system include modules for dispensing the biological sample or for incubating the sample. The test trays may be manually loaded into the sensing and detecting modules and positioned appropriately.

V. Monitoring Response of the Biological Sample

Various responses may be determined using the test tray system. In certain preferred embodiments of the invention the response to be determined is cell viability or proliferative capacity or, conversely, cell death or cessation of growth/division. For example, if the test tray is used to determine a preferred compound or compound combination to combat a pathogenic bacterium, the response to be determined may be the ability of the bacterium to grow or proliferate in the presence of different compounds or compound combinations. A preferred compound or compound combination may be one that maximally reduces bacterial survival and/or proliferation. Similar considerations would apply if the test tray is used to determine a preferred compound or compound combination to combat a yeast or protozoan. The foregoing examples assumed that the organism being tested was able to proliferate outside the cells of a host organism. However, as is known to one of ordinary skill in the art certain bacteria, viruses, yeast, and protozoa typically survive and/or proliferate only within host cells, at least during a portion of their life cycle. If the test tray is used to determine a preferred compound or compound combination to combat such a pathogen, the response to be determined may be the ability of a host cell infected with the pathogen to grow or proliferate in the presence of different compounds or compound combinations. A preferred compound or compound combination may be one that allows maximal survival and/or proliferation of the host cell.

A number of techniques may be utilized to detect and/or quantify response. In certain embodiments of the invention cellular viability and/or proliferation is monitored using optical density. Sensing of optical density can be carried out using absorbance measurements at 600 nm, which is the standard approach in laboratory analysis. Typically a light source provides light to one side of the well and light transmitted through the well is captured at a different side. Appropriate light sources, detectors, and light transmission devices as are known to one of ordinary skill in the art may be used. Sources of light energy include, but are not limited to, arc lamps, photodiodes, and lasers. Conventional detectors such as photomultiplier tubes, photodiodes, photoresistors or charge coupled device (CCD) cameras may be employed. Equipment such as lenses, filters, beam splitters, dichroics, prisms and mirrors may be incorporated, e.g., to enhance detection and accuracy.

The invention also encompasses the detection of cell metabolites indicative of cell viability and/or proliferation including, among others, NAD(P)H (a pyridine nucleotide that is an endogenous chromophore that may serve as a fluorescence indicator), as an alternate or complementary means of monitoring cell viability and/or proliferation (See, e.g., Zabriskie, D, et al. "Estimation of fermentation biomass concentration by measuring culture fluorescence", *Appl. Eur. Microbiol.* 1978, Vol. 35(2), pp. 337-343; Marose, S., et al. "Two-dimensional fluorescence spectroscopy: A new tool for online bioprocess monitoring", *Biotechnology Progress,* 1998, 14, pp. 63-74).

As mentioned above, in certain embodiments of the invention detecting and/or quantifying cellular response, e.g., cellular viability and/or proliferation, involves providing an indicator that interacts (either directly or indirectly) with the cells or with a cell product to provide a signal indicative of cellular response. For example, the indicator may be a substrate that is metabolized by the cell so that cellular viability and/or proliferation may be determined by detecting and/or measuring the substrate. Alternatively, the indicator may be an enzyme to which a readily detectable marker such as a fluorescent moiety may be attached. In certain embodiments of the invention a property of the indicator (e.g., fluorescence) is altered due to interaction with or metabolism by the cells.

In one example of such a technique, cell viability in the wells is measured using a pH indicator, 2'-7'-bis-(2carboxyethyl)-5-(and-6-)-carboxyfluorescein (BCECF-AM). This compound has an excitation wavelength of 505 nm and an emission wavelength of 535 nm and is available from Molecular Probes (Eugene, Oreg.). The acetoxymethyl (AM) ester form of BCECF is non-fluorescent in solution. BCECF-AM is cell membrane permeant and passively enters the cell. Inside the cell, the lipophilic blocking groups are cleaved by non-specific esterases resulting in an increase in fluorescent intensity. This increase in fluorescent intensity is indicative of the cell viability.

In another approach, a commercial cell viability assay, LIVE/DEAD.RTM. from Molecular Probes (Eugene, Oreg.) is used. This assay provides a two-color fluorescence cell viability assay based on intracellular esterase activity and plasma membrane integrity. Live cells are able to enzymatically convert the cell-permeant non-fluorescent molecule calcein AM to fluorescent calcein, which has an excitation wavelength at 495 nm and an emission wavelength at 515 nm. Dead cells are distinguished by binding ethidium homodimer (EthD-1), which has an excitation wavelength at 495 nm and an emission wavelength at 635 nm, to nucleic acids. Binding of this molecule to nucleic acids results in a 40-fold increase in fluorescent intensity. EthD-1 cannot cross the intact plasma membranes of living cells, so an increase in fluorescent intensity is indicative of cell death.

In embodiments of the invention in which external optical stimulation of cells is needed to detect cellular response, conventional light sources such as arc lamps, photodiodes, or lasers may be employed for excitation light energy. Cell responses may be monitored by conventional detectors such as photomultiplier tubes, photodiodes, photoresistors or charge coupled device (CCD) cameras. Excitation and detection wavelengths will vary depending upon the indicator that is used. Appropriate optical train components, such as lenses, filters, beam splitters, dichroics, prisms and mirrors may be employed to convey light to an from such light sources and detectors either to discrete substrate sites or through optical fiber strands to microwells that contain individual cells. In certain preferred embodiments of the invention data is gathered from the wells in parallel rather than sequentially.

VI. Test Tray Applications and Methods of Use

The test trays are suitable for any of a wide variety of applications in which it is desirable to determine the effect of a plurality of compounds on a biological sample, particularly when it is desired to determine the effect of combinations of compounds. The large number of wells and the fact that the compounds are predispensed in predetermined combinations and concentrations greatly streamlines the process of determining optimal compounds, compound combinations, and compound concentrations. By arranging the compounds in accordance with a preselected factorial design certain embodiments of the invention allow the power of the factorial design approach to be employed without the labor and time of setting up individual experiments.

Typical uses for the test trays include, but are not limited to: (1) determining whether a biological agent in the biological sample is susceptible to certain potential biocides; and (2) determining optimal combinations and concentrations of biocides to maximize killing or neutralization of a biological agent. The test trays may also be employed to (1) determine optimal combinations and concentrations of compounds to maximize biosynthesis of a desired product by a biological agent; (2) determine optimal combinations and concentrations of compounds to maximize biotransformation of an unwanted component such as a toxic chemical by a biological agent, etc.

In a typical application, a test lab receives a biological sample containing bacteria. The sample may be a material obtained from a subject, e.g., blood, saliva, urine, etc. Alternately, the sample may be material obtained from the environment such as a swab taken from a surface. The identity of the bacteria may be known or unknown. The sample may be cultured in order to obtain a larger population of microorganisms, but this is not necessary.

A test tray having wells whose contents are arranged in accordance with a desired factorial design is selected. Choice of a particular design may be guided by, e.g., whether the user wishes to perform a screening test or whether the user desires to detect interaction effects. The test tray is removed from its sealed package, and the compounds are reconstituted. An aliquot of the sample is added to each well. These steps may be performed automatically by the test system. The test system reads information from the test tray that identifies the particular factorial design.

VII. Exemplary System Utilizing the Invention

Figure 4:
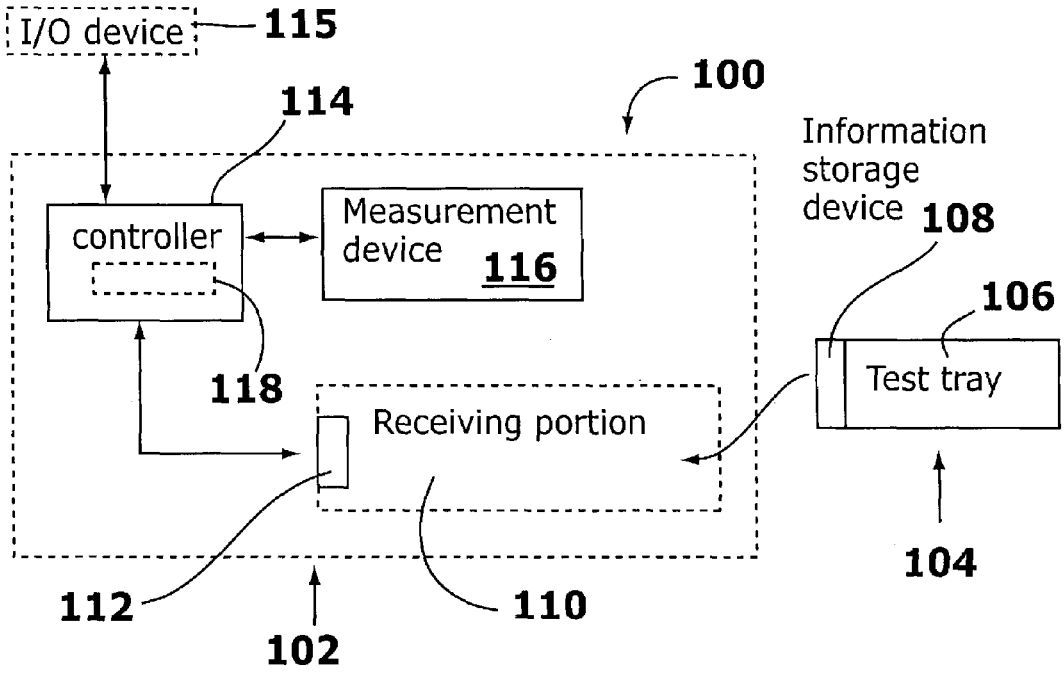
FIG. 4 is a block diagram of an exemplary embodiment of a test tray system.

By way of illustrative embodiment, the test system 100 of FIG. 4 utilizes the apparatus and method of the present invention. Test system 100 includes test platform 102 and test tray 104.

Test tray 104 contains a factorial matrix array 106 of different combinations and/or concentrations of compounds or reagents. This matrix array is a particular factorial matrix array that can be selected from a plurality of test trays containing different factorial matrix arrays by an operator of test system 100 whose objective may be, for example, to determine an optimal combination of compounds or reagents to apply to a given biological sample.

Test tray 104 also includes an information storage device 108 that stores information indicative of the particular factorial matrix array 106 that is disposed and arranged in test tray 104. The information storage device is preferably a memory device such as an EEPROM but it can also be a bar code (to be read by a wand for example), a non-contact RF memory device, a magnetic strip, or any other suitable device that can store the appropriate information.

The test platform 102 includes a receiving portion 110 for receiving the test tray 104. The receiving portion 110 preferably includes a coupling apparatus or reader 112 that couples with the information storage device 108 upon installation of the test tray into the receiving portion. (The reader may include electrical contacts for coupling to a memory device, a user applied bar code reader, a non-contact antenna, or a magnetic reader according to what type of information storage device is utilized.) The reader enables the transfer of information between the information storage device and a controller 114 to be discussed next.

The test platform 102 includes a measurement or detection device 116 that senses the effect of the reagents upon the biological sample at various locations on the test tray 104, i.e., in various wells. The test platform 102 further includes the controller 114 that is coupled to the measurement device 116 and the coupling apparatus 112. The controller 114 is responsive to the information received from the information storage device 108. The controller 114 is depicted as being integrated with the test platform but the controller could just as easily include external portions such as a personal computer (not shown). Also, controller 114 may include I/O device(s) 115 for inputting or viewing information. Examples of devices 115 include conventional computer keyboards, monitors, computer networks, and printers for example.

The controller 114 includes software and software algorithms 118 that correspond to particular ones of a plurality of different factorial experimental designs. The controller 114 is responsive to the information from the information storage device 108 to select from the software algorithms.

VIII. Exemplary Method Employing the Invention

Figure 5:
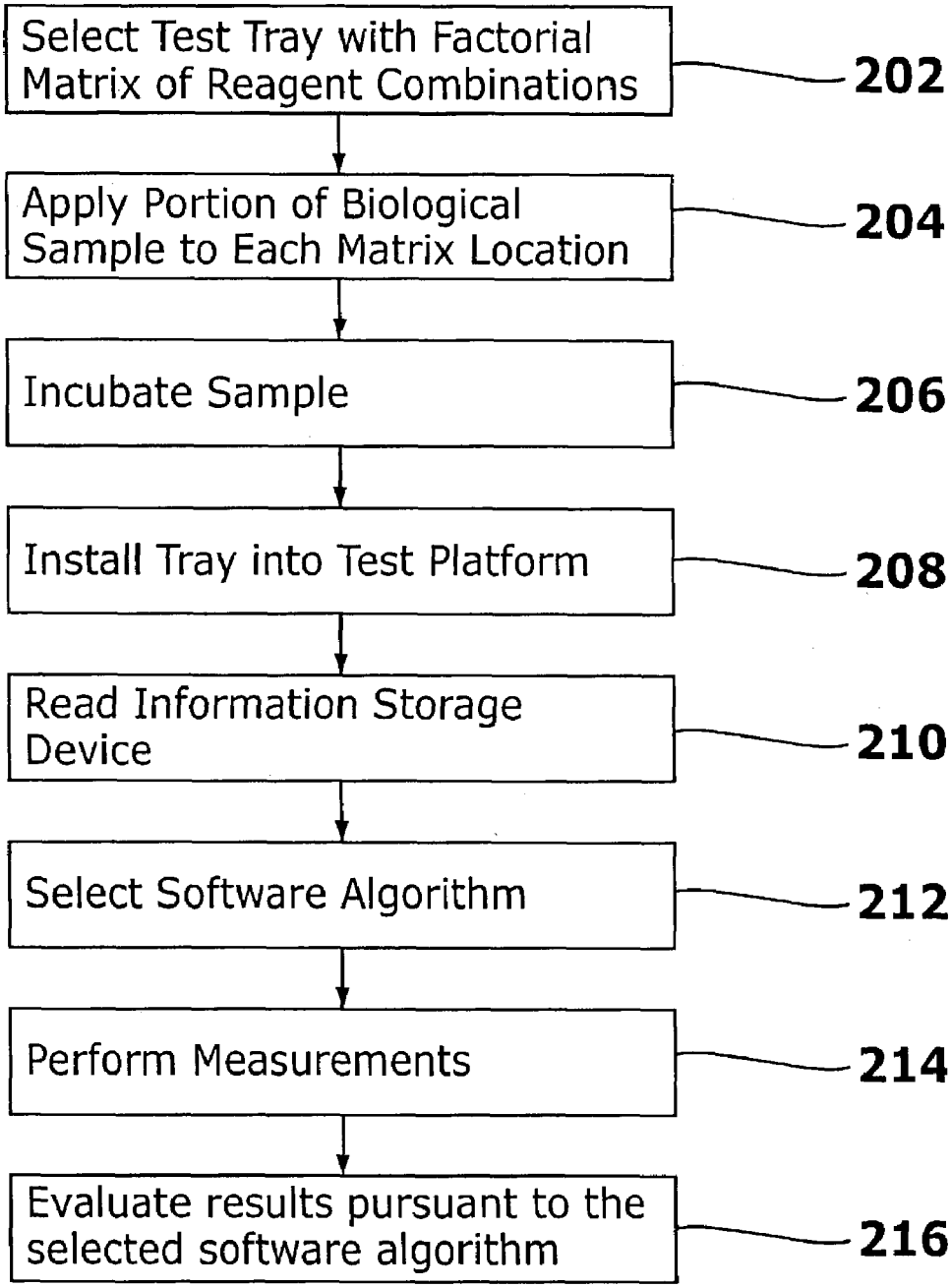
FIG. 5 is a flow chart showing an exemplary method of using the test tray and test system.

By way of illustrative embodiment, FIG. 5 depicts a method utilizing the present invention and utilizing test system 100. While the method depicts a particular ordering of process steps, it is to be understood that steps of this method can be reordered temporally based upon the particular way in which the invention is employed.

When it is desired to evaluate the response of a biological sample, the operator of test system 100 selects a test tray 104 having a particular factorial matrix combination of reagents from a plurality of test trays having different factorial combinations of reagents as indicated in 202. A portion of a biological sample is applied to each of the wells according to 204. In one embodiment, according to step 206 the test tray 104 is then stored to allow the effects of the reagents upon the sample to become apparent and/or to allow growth of the biological sample.

According to step 208, the test tray 104 is installed into the receiving portion 110 of the test platform 102. Appropriate software instructions are then executed to enable the test system 100 to evaluate the effects of the reagents upon the sample. In response to the software instructions the controller 114 activates the detection or measurement device 116 to enable data or measurement information acquisition from the test tray 104.

Upon installation of the tray 104 into the receiving portion 110, the information storage device 108 couples with the reader 112. Information indicative of the factorial matrix being performed is then transferred from the information storage device 108 to the controller 114 according to step 210. In response to receiving the information, the controller 114 selects a particular software algorithm from a plurality of software algorithms 118 according to step 212. The particular software algorithm is adapted to analyze results from the particular factorial matrix combination to provide results for the particular experiment selected.

This method of automatic selection of a software algorithm has advantages. First, it eliminates the potential for human error in selecting a proper software algorithm. Many potential errors are eliminated, ranging from such simple errors as data entry errors to major errors such as selecting the wrong mathematical algorithm for data analysis. Second, the operator of test system 100 does not need to have expertise in statistical analysis or complex computer interfaces. This allows the operator, who may be a biologist, for example, to focus on the biology and not on methods of analysis.

According to step 214, controller 114 activates measurement device 116 and measurements are made. One aspect and advantage of information storage device 108 is that the controller can read information from information storage device indicative of the locations of the wells in test tray 104. This information can be used to allow controller 114 to apply proper drive signals to an xy stage that can be a portion of receiving portion 110 so that the xy state of receiving portion 110 can properly position each well under a detector that is a part of measurement device 116.

According to step 216, information indicative of the results of the matrix points are then evaluated using the particular software algorithm selected during step 212. The results of the test can then be provided to the operator via the I/O device(s) 116.

In other embodiments, step 210 also includes the transfer of additional information between information storage device 108 and controller 114. As a first embodiment, controller 114 receives information indicative of a freshness date, a manufacture date, and/or a shelf life of the test tray 104. In the event that the shelf life of test tray 104 is exceeded, the controller 114 enables the display of a warning to the user of test system via I/O device 116. In a second embodiment, controller 114 prevents the use of test tray 104 in the event that the shelf life would compromise the results of a test utilizing test tray 104. In a third embodiment, controller 114 records the test tray shelf life information along with results of the experiment.

As a second embodiment, controller 114 writes usage information to information storage device 108. The user may initially install test tray 104 into test platform 102 prior to the incubation step 206. Later, when the tray is installed again, the test system can track the incubation time at the time the measurement device 116 is employed.

EQUIVALENTS

Those skilled in the art will recognize, or be able to ascertain using no more than routine experimentation, many equivalents to the specific embodiments of the invention described herein. The scope of the present invention is not intended to be limited to the above Description, but rather is as set forth in the appended claims.

What is claimed is:

1. A high density test tray and controller combination for assessing the response of a biological sample to a plurality of compounds, comprising:

a body having a surface with a plurality of wells with each respective well containing at least one compound of the plurality of compounds, wherein the plurality of compounds are arranged on the test tray according to a factorial matrix design, wherein the factorial matrix design includes multiple repetitions of a plurality of trials, and wherein the respective compounds are present in different wells of the plurality of wells at a range of concentrations of the at least one compound; and an information storage device disposed on the body of the test tray, wherein the information storage device stores information that is indicative of the factorial matrix design;

wherein the body and information storage device are in electronic communication with the controller, the controller being configured to automatically select a factorial matrix arranged with the array of wells according to the factorial matrix design based on the information stored in the information storage device, the controller comprising a memory configured to store a plurality of different software algorithms, with each respective software algorithm configured for analyzing a respective factorial matrix of a plurality of factorial matrixes, and the controller being configured to automatically select, based on the information stored in the information storage device, the respective software algorithm from the plurality of different software algorithms, the respective software algorithm being specifically configured to analyze the respective factorial matrix from the plurality of factorial matrixes;

and wherein the controller is in electronic communication with a detection device, the detection device being configured to assess the response of the biological sample to the respective compounds in each respective well of the test tray.

2. The combination of claim 1, wherein each well contains a combination of at least two compounds.

3. The test tray of claim 1, wherein the factorial design is a linear design.

4. The combination of claim 1, wherein the factorial design is a fractional factorial design.

5. The combination of claim 1, wherein at least one compound is an antimicrobial agent.

6. The combination of claim 1, wherein at least one compound is a pharmaceutical agent.

7. The combination of claim 1, wherein the plurality of wells includes at least 1000 wells.

8. The combination of claim 1, wherein the plurality of wells includes at least 10,000 wells.

9. The combination of claim 1, wherein the plurality of wells includes at least 100,000 wells.

10. The combination of claim 1, wherein at least a portion of each respective well has at least one capillary sized dimension.

11. The combination of claim 1, wherein the factorial design is preselected.

12. The combination of claim 1, wherein the compounds are predispensed.

13. The combination of claim 1, wherein the compounds are dessicated.

14. The combination of claim 1, further comprising a sealing element removably covering the test tray.

15. The combination of claim 1, wherein the information storage device is selected from the group consisting of electrical storage devices, optical storage devices, and magnetic storage devices.

16. The combination of claim 1, wherein the information storage device is a read/write memory.

17. A method of fabricating a high density test tray, comprising:

providing a test tray having a plurality of wells arranged in a high density pattern and configured to receive a plurality of compounds, the test tray including an information storage device and the plurality of compounds including at least one of an antimicrobial agent or a pharmaceutical agent;

selecting a factorial matrix design;

storing information indicative of the factorial matrix design in the information storage device of the test tray to store the information independent of the respective compounds;

dispensing a plurality of compounds into the plurality of wells of the test tray using a programmably controllable fluid dispensing device and according to the factorial matrix design, including dedicating one or more nozzles of at least one printhead of the programmably controllable fluid dispensing device to each of a plurality of different compounds;

providing a detection device for assessing responses of biological samples to the plurality of compounds in each respective well of the test tray; and providing a controller, the controller comprising a memory configured to store a plurality of different software algorithms with each respective software algorithm configured for analyzing a respective factorial matrix of the plurality of factorial matrixes and configured to automatically select, based on the information stored in the information storage device, the respective software algorithm from the plurality of different software algorithms to analyze the respective factorial matrix from the plurality of factorial matrixes.

18. The method of claim 17, wherein the step of dispensing comprises dispensing varying numbers of drops of a compound into the respective wells, the respective wells each having a different desired final compound concentration.

19. The method of claim 17, wherein at least one compound is an antimicrobial agent.

20. The method of claim 17, wherein at least one compound is a pharmaceutical agent.

21. The method of claim 17, wherein the plurality of wells includes at least 1000 wells.

22. The method of claim 17, wherein the plurality of wells includes at least 10,000 wells.

23. The method of claim 17, wherein the plurality of wells includes at least 100,000 wells.

24. An automated system for detecting the response of a biological sample to a plurality of reagents, the system comprising:

a test tray including:

an array of wells;

a first factorial matrix of test reagent mixtures arranged within the array of wells, the first factorial matrix selected from a plurality of different factorial matrices of test reagent mixtures; and an information storage device disposed on the test tray, the information storage device configured to store information indicative of the factorial matrix;

a test platform including a receiving portion for receiving the test tray;

a controller configured for controlling portions of the test platform upon installation of the test tray and being responsive to the information stored in the information storage device of the test tray, the controller comprising a memory configured to store a plurality of different software algorithms with each respective software algorithm configured for analyzing a respective factorial matrix of the plurality of factorial matrixes and configured to automatically select, based on the information stored in the information storage device, the respective software algorithm from the plurality of different software algorithms to analyze a respective factorial matrix from the plurality of factorial matrixes; and detection means for assessing the response of the biological sample to a compound or compound combination of the test reagent mixtures in each respective well of the test tray.

25. The system of claim 24, wherein the compounds or compound combinations of the test reagent mixtures are predispensed.

26. The system of claim 24, wherein the factorial design includes multiple repetitions of a plurality of trials.

27. The system of claim 24, wherein the plurality of wells includes at least 1,000 wells containing compounds or compound combinations of the test reagent mixtures.

28. The system of claim 24, wherein the plurality of wells includes at least 10,000 wells containing compounds or compound combinations of the test reagent mixtures.

29. The system of claim 24, wherein the plurality of wells includes at least 100,000 wells containing compounds or compound combinations of the test reagent mixtures.

30. The system of claim 24, further comprising:

code to analyze the response of the biological sample to the compound or compound combinations of the test reagent mixtures and to select an optimum compound combination based on the response.

31. The system of claim 24, further comprising means for allowing the response in the wells to be detected in a random order.

32. The automated system of claim 24, wherein each respective well of the array of wells has a different location on the test tray; and the information storage device stores storing information indicative of the different locations of the test tray.

33. The automated system of claim 32, wherein the controller is responsive to the information indicative of the locations to enable the system to properly align a measurement device with each of the wells.

34. A high density test tray for assessing the response of a biological sample to a plurality of compounds, comprising:

a body having a surface with a plurality of wells with each respective well containing at least one compound of the plurality of compounds, wherein the plurality of compounds are arranged on the test tray according to a factorial matrix design, wherein the factorial matrix design includes multiple repetitions of a plurality of trials, wherein the respective compounds are present in different wells of the plurality of wells at a range of concentrations of the at least one compound, wherein each well contains a combination of at least two compounds, and wherein at least a portion of each respective well has at least one capillary sized dimension; and an information storage device disposed on the body of the test tray, wherein the information storage device stores information that is indicative of the factorial matrix design;

wherein the body and information storage device are in electronic communication with the controller, the controller being configured to automatically select a factorial matrix arranged with the array of wells according to the factorial matrix design based on the information stored in the information storage device, the controller comprising a memory configured to store a plurality of different software algorithms, with each respective software algorithm configured for analyzing a respective factorial matrix of a plurality of factorial matrixes, and the controller being configured to automatically select, based on the information stored in the information storage device, the respective software algorithm from the plurality of different software algorithms to analyze the respective factorial matrix of a plurality of factorial matrixes;

and wherein the controller is in electronic communication with a detection device, the detection device being configured to assess the response of the biological sample to the respective compounds in each respective well of the test tray.

35. The combination of claim 34, wherein the compounds are predispensed.

* * * * *

UNITED STATES PATENT AND TRADEMARK OFFICE

CERTIFICATE OF CORRECTION

PATENT NO. : 7,517,494 B2
APPLICATION NO. : 10/428289
DATED : April 14, 2009
INVENTOR(S) : Winthrop D. Childers et al.

It is certified that error appears in the above-identified patent and that said Letters Patent is hereby corrected as shown below:

In column 22, line 6, in Claim 3, delete "The test tray" and insert -- The combination --, therefor.

In column 22, line 8, in Claim 4, delete "The combination" and insert -- The test tray --, therefor.

In column 22, line 10, in Claim 5, after "wherein" insert -- the --.

In column 22, line 12, in Claim 6, after "wherein" insert -- the --.

In column 24, line 18, in Claim 34, delete "high density test tray" and insert -- high density test tray and controller combination --, therefor.

Signed and Sealed this

First Day of December, 2009

David J. Kappos

David J. Kappos
*Director of the United States Patent and Trademark Office*